US006481396B2

(12) United States Patent
Stolk et al.

(10) Patent No.: US 6,481,396 B2
(45) Date of Patent: Nov. 19, 2002

(54) ELECTROMAGNETIC ACTUATOR FOR OPERATING A GAS EXCHANGE VALVE OF AN INTERNAL COMBUSTION ENGINE

(75) Inventors: Thomas Stolk, Kirchheim (DE); Alexander von Gaisberg, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/910,470

(22) Filed: Jul. 20, 2001

(65) Prior Publication Data

US 2002/0020372 A1 Feb. 21, 2002

(30) Foreign Application Priority Data

Jul. 22, 2000 (DE) ..... 100 35 759

(51) Int. Cl.[7] ..... F01L 9/04

(52) U.S. Cl. ..... 123/90.11; 123/41.34; 251/129.09; 251/129.16

(58) Field of Search ..... 123/90.11, 40.33, 123/40.36, 40.38, 41.34, 188.9; 251/355, 356, 129.01, 129.09, 129.16

(56) References Cited

U.S. PATENT DOCUMENTS

| | | | | |
|---|---|---|---|---|
| 6,089,197 A | * | 7/2000 | Lange et al. | 123/90.11 |
| 6,237,550 B1 | * | 5/2001 | Hatano et al. | 123/90.11 |
| 6,262,498 B1 | * | 7/2001 | Leiber | 123/90.11 |

FOREIGN PATENT DOCUMENTS

| | | | |
|---|---|---|---|
| DE | 196 28 860 | * | 1/1998 |
| DE | 197 14 496 | * | 10/1998 |
| JP | 11 036829 | | 5/1999 |

* cited by examiner

*Primary Examiner*—Weilun Lo
(74) *Attorney, Agent, or Firm*—Klaus J. Bach

(57) ABSTRACT

In an electromagnetic actuator for actuating a gas exchange valve of an internal combustion engine, the actuator includes at least one electromagnet which is arranged in a housing and acts on an armature through which at least one passage extends transversely with respect to the direction of movement of the armature for conducting a coolant through the armature.

8 Claims, 3 Drawing Sheets

ELECTROMAGNETIC ACTUATOR FOR OPERATING A GAS EXCHANGE VALVE OF AN INTERNAL COMBUSTION ENGINE

BACKGROUND OF THE INVENTION

The invention relates to an electromagnetic actuator for operating a gas exchange valve of an internal combustion engine, wherein the actuator includes at least one electromagnet, which is arranged in a housing and acts on an armature.

DE 197 14 496 A1 discloses an electromagnetic actuator of this general type for actuating a gas exchange valve of an internal combustion engine. An opening magnet and a closing magnet which each have a magnet coil wound onto a coil core are arranged in an actuator housing. The magnets act on an armature adapted to move in the axial direction of the valve. Furthermore, the actuator includes a cooling structure having a cooling passage extending in the actuator housing. Bores in the actuator housing form the cooling passage. Cooling liquid can be conducted through the cooling passage without coming into direct contact with the magnet coils and the coil cores.

Furthermore, DE 196 28 860 A1 discloses an electromagnetic actuator for actuating a gas exchange valve of an internal combustion engine having a pivoting armature, which is mounted between two electromagnets in a manner such that it can pivot about an axis.

It is the object of the present invention to provide an improved actuator of this type.

SUMMARY OF THE INVENTION

In an electromagnetic actuator for actuating a gas exchange valve of an internal combustion engine, the actuator includes at least one electromagnet which is arranged in a housing and acts on an armature through which at least one passage extends transversely with respect to the direction of movement of the armature for conducting a coolant through the armature.

As the cooling fluid passage extends through the armature advantageous cooling of the armature can be achieved and heat can be removed from a core of the electromagnet via the armature. As a result, the degree of efficiency of the actuator can be increased. If an armature is guided displaceably in a translatory manner, the fluid may, for example, be conducted into the armature via a bearing of an armature tappet and via the armature tappet.

However, it is particularly advantageous for the armature to be designed as a pivoting armature and for the fluid to be fed in by way of a bearing point of the armature. With little structure outlay, the coolant can then be conducted through a short path into the armature and, in addition, a play-compensating element can be supplied in a particularly advantageous manner with a pressure medium via the passage in the armature, the play-compensating element being arranged, for example, between the armature and an armature stem or valve stem.

In a particular embodiment of the invention, the fluid is removed at a second bearing point of the armature. As a result, a large through-flow through the armature and good dissipation of heat can be achieved. In principle, however, the medium could also be removed at another point, for example a point on the armature, via a play-compensating element, etc.

If the armature is connected to a hollow pivoting spindle, the medium can be fed to the armature via the pivoting spindle in a structurally simple and cost-effective manner. If the medium is fed in via a first bearing point of the armature and the medium is removed via a second bearing point, it is advantageous if a partition is arranged between the bearing points of the hollow pivoting spindle, by which partition a direct flow through the pivoting spindle and a flow short circuit of the passage in the armature can be avoided. The partition can be formed integrally with the pivoting spindle or else as a separate component, which is inserted into the pivoting spindle. If the pivoting spindle is connected via the partition to a torsion spring, additional components, weight, outlay on installation and costs can be saved.

In another embodiment of the invention, the armature is mounted via at least one bearing bolt and the medium is fed into the armature through a passage in the bearing bolt. A pressure drop upstream of the passage can be avoided and a large through-flow can be achieved. With small pressure drops, a play-compensating element can be supplied with pressure medium via the armature. However, it is also possible to supply the medium to the passage via a bearing surface or else via a bearing surface of an anti-friction bearing, as a result of which the bearing surfaces can be advantageously lubricated by the medium at the same time. The medium can be formed by different substances which, for example, are designed primarily for transporting away heat or for lubrication. However, it is particularly advantageous if the medium is internal combustion engine oil, which can be used as pressure medium for a play-compensating element, for cooling and for lubricating and, which, in principle, is available in any internal combustion engine.

Preferably, the passage extends in a curved manner through the armature, as a result of which a large cooling surface and an advantageous dissipation of heat from the armature can be achieved with a small pressure drop. However, it is also possible for the passage to extend rectilinearly through the armature or to consist of a plurality of rectilinear sections.

Further advantages will become apparent from the following description of the invention on the basis of the accompanying drawings.

DESCRIPTION OF PREFERRED EMBODIMENTS

Figure 1:
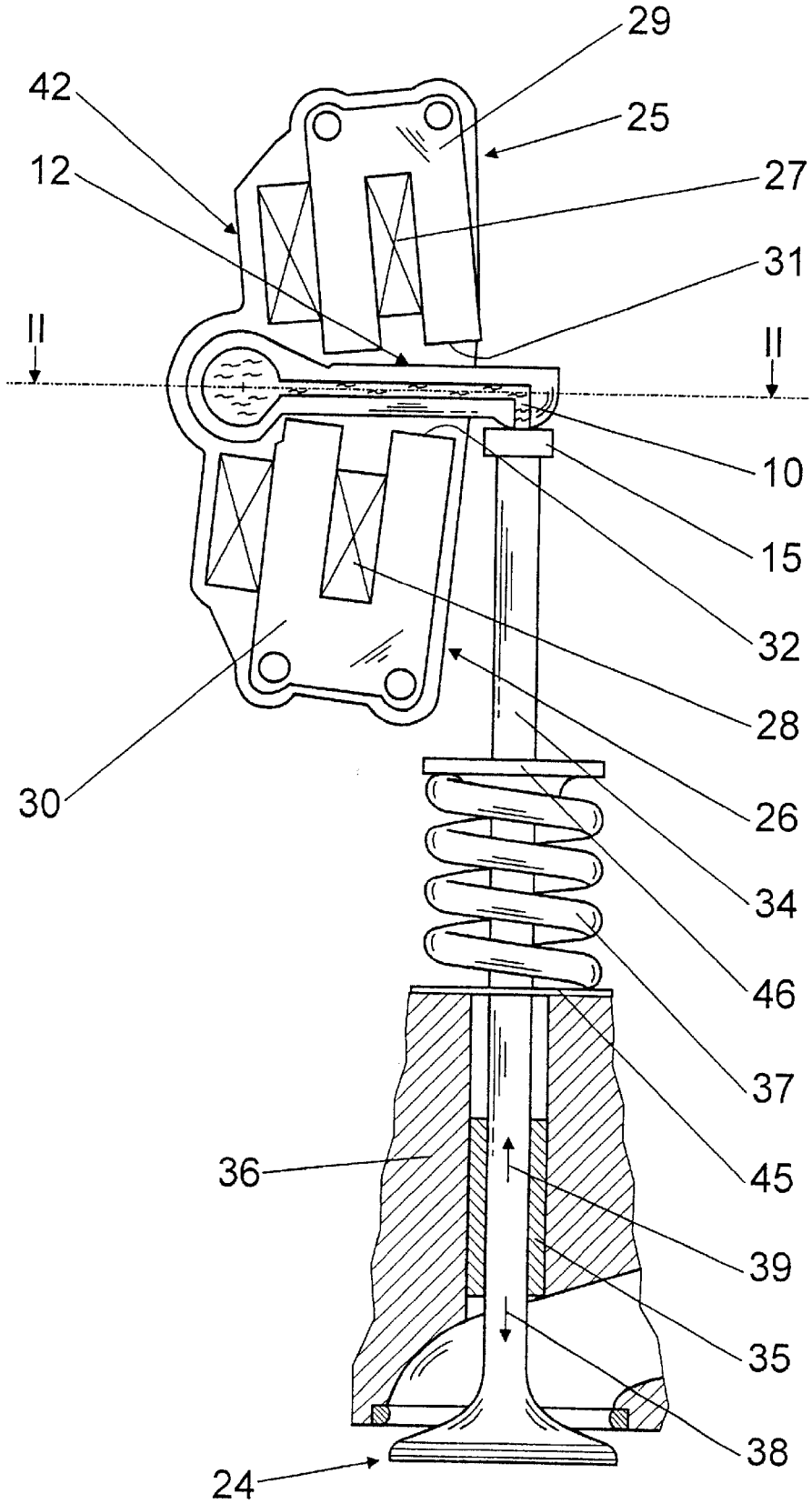
FIG. 1 is a longitudinal cross-sectional view of a schematically illustrated actuator according to the invention.

FIG. 1 shows an electromagnetic actuator for operating a gas exchange valve 24 of an internal combustion engine (not illustrated in detail). The actuator includes an electromagnetic unit having two electromagnets 25, 26—an opening magnet 26 and a closing magnet 25. Each of the electromagnets 25, 26 has a magnet coil 27, 28, which is wound onto a coil support (not illustrated in detail) and a coil core 29, 30 having two yoke-type legs. which have pole faces 31, 32 at the ends thereof. A pivoting armature 12 is mounted between the pole faces 31, 32, in a manner such that it can pivot about an axis. The pivoting armature 12 acts on the gas exchange valve 24 via a play-compensating element 15 and a valve stem 34. The valve stem 34 is mounted in an axially displaceable manner in a cylinder head 36 of the internal combustion engine via a stem guide 35.

Figure 2:
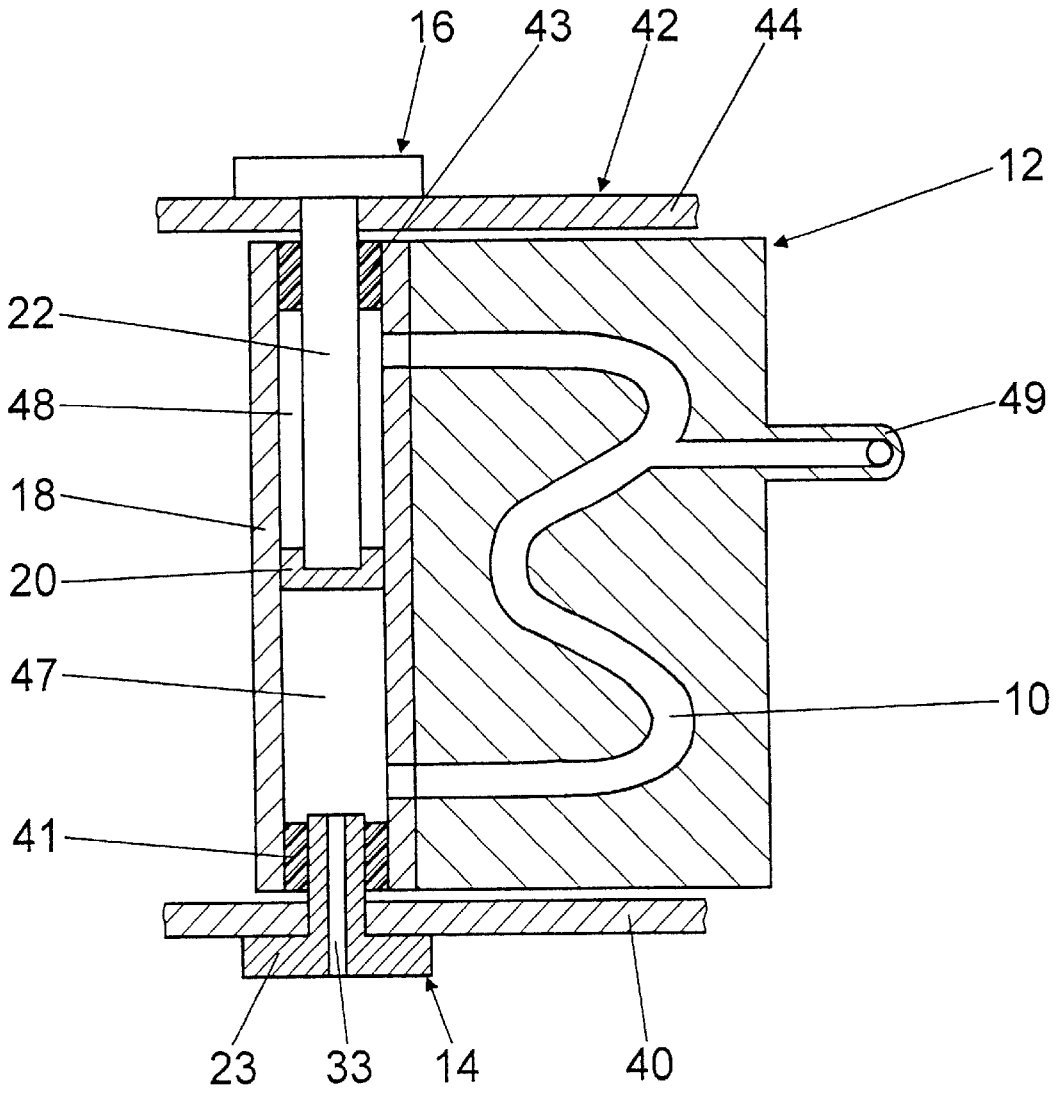
FIG. 2 shows a section taken along line II—II of FIG. 1.

Furthermore, the actuator has a spring mechanism having two pre-stressed valve springs 22, 37. The valve springs 22 and 37 specifically comprise as a valve spring 22 a torsion spring, which acts in the opening direction 38 and a helical compression valve spring 37, which acts in the closing direction 39 of the valve 24 (FIGS. 1 and 2).

The pivoting armature 12 is welded fixedly to a hollow pivoting spindle 18. At a first bearing point 14, the pivoting spindle 18 is mounted via a first friction bearing 41 on a bearing bolt 23 in a first housing wall 40 of an actuator housing 42. At a second bearing point 16, the spindle 18 is mounted via a second friction bearing 43 on the torsion spring 22 in a second housing wall 44 of the actuator housing 42.

The torsion spring 22 is connected in a rotationally fixed manner at one end to the housing wall 44 and acts on the gas exchange valve 24 via a partition 20 to which the other end of the torsion spring 22 is connected. The partition is arranged in a rotationally fixed manner in the pivoting spindle 18, which carries the pivoting armature 12 that engages the valve stem 34. The helical compression spring 37 is supported on the cylinder head 36 via a first spring rest 45 and acts on the gas exchange valve 24 via a second spring rest 46 and via the valve stem 34. When the electromagnets 25, 26 are not excited, the pivoting armature 12 is held in a position of equilibrium between the pole faces 31, 32 of the electromagnets 25, 26 by the valve springs 22, 37.

When the actuator is initially activated, either the closing magnet 25, or the opening magnet 26 is briefly overexcited, or an oscillation excitation routine is used to excite the pivoting armature 12 at its resonant frequency in order to be moved out of the position of equilibrium. In the closed position of the gas exchange valve 24, the pivoting armature 12 bears against the pole face 31 of the excited closing magnet 25 and is held by the latter. The closing magnet 25 further pre-stresses the valve spring 22, which acts in the opening direction 38. In order to open the gas exchange valve 24, the closing magnet 25 is de-energized and the opening magnet 26 is energized. The valve spring 22, which acts in the opening direction 38, accelerates the pivoting armature 12 beyond the position of equilibrium and the pivoting armature is attracted by the opening magnet 26. The pivoting armature 12 strikes against the pole face 32 of the opening magnet 26 and is firmly held by the latter. In order to close the gas exchange valve 24 again, the opening magnet 26 is de-energized and the closing magnet 25 is energized. The valve spring 37, which acts in the closing direction 39, accelerates the pivoting armature 12 beyond the position of equilibrium toward the closing magnet 25. The pivoting armature 12 is attracted by the closing magnet 25, strikes onto the pole face 31 of the closing magnet 25 and is firmly held by the latter.

According to the invention, internal combustion engine oil is conducted from a pressure connection (not illustrated in detail) at the first bearing point 14 of the pivoting armature 12 through a passage 33 in the bearing bolt 23, which is coaxial with the pivoting spindle 18, into a first cavity 47 of the pivoting spindle 18. This cavity 47 is bounded, in the direction of the second bearing point 17, by the partition 20. The internal combustion engine oil is conducted out of the cavity 47 and through a curved passage 10, which extends through the pivoting armature 12. The passage 10 extends essentially transversely with respect to the direction of movement of the pivoting armature 12 and branches into a projection 49 which is integrally formed on the pivoting armature 12 and provides for a valve operating structure. From there, the oil flows out of the projection 49 into the play-compensating element 15 (FIGS. 2 and 1) for supplying the play-compensating element 15 with pressure medium via the passage 10.

The passage 10 is formed in the pivoting armature 12 by a precision-casting process. In principle, however, a passage which is composed of rectilinear sections and is produced by boring could be formed in the pivoting armature. The pivoting armature could also be composed of at least two joined parts, in which case the passage could be formed between two parts.

Furthermore, the passage 10 extends to a second cavity 48 of the pivoting spindle 18 adjacent the second bearing point 16. The cavity 48, which is bounded by the partition 20, receives the oil from the passage 10. From there, the internal combustion engine oil is conducted out of the actuator via a bearing surface of the friction bearing 43. The internal combustion engine oil lubricates the friction bearing 43. An advantageous through-flow through the pivoting armature 12 to obtain good cooling can be achieved as the oil pressure must be sufficiently high for the play-compensating element 15.

Figure 3:
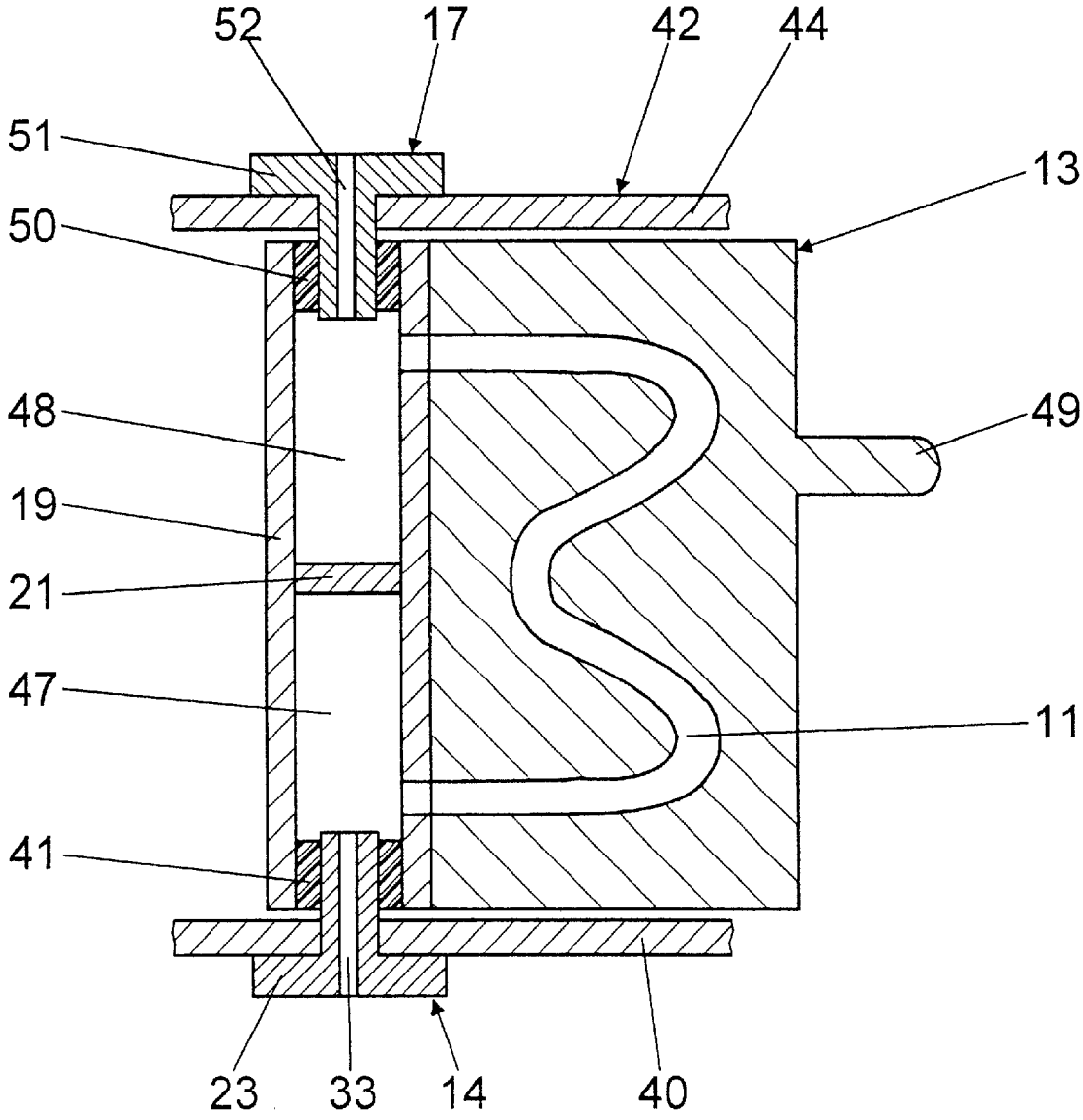
FIG. 3 shows a variant of FIG. 2.

FIG. 3 illustrates an alternative pivoting armature 13 to FIG. 2. Components, which remain substantially the same, are numbered with the same reference numbers. Furthermore, reference can be made to the description of the exemplary embodiment shown in FIGS. 1 and 2 as regards features and functions, which remain the same.

The pivoting armature 13 is welded to a hollow pivoting spindle 19, which, at a first bearing point 14, is mounted via a first friction bearing 41 on a first bearing bolt 23 in a first housing wall 40 of an actuator housing 42. At a second bearing point 17, the spindle 19 is mounted via a second friction bearing 50 on a second bearing bolt 41 in a second housing wall 44.

Internal combustion engine oil is conducted from a pressure connection (not illustrated in detail) via the first bearing point 14 of the pivoting armature 13 through a passage 33 which is coaxial with the pivoting spindle 19 in the bearing bolt 23 into a first cavity 47 of the pivoting spindle 19. This cavity 47 is bounded in the direction of the second bearing point 17 by a partition 21. The internal combustion engine oil is conducted out of the cavity 47 via a curved passage 11, which extends through the pivoting armature 13 transversely with respect to the direction of movement of the pivoting armature 13. It leads to a second cavity 48 of the pivoting spindle 18, which cavity faces the second bearing point 16, and is bounded by the partition 20. From the cavity 48 the internal combustion engine oil is conducted out of the actuator via a passage 52 extending co-axially with the pivoting spindle 19 through the bearing bolt 51.

What is claimed is:

1. An electromagnetic actuator for operating a gas exchange valve of an internal combustion engine, said actuator having at least one electromagnet which is arranged in a housing and acts on an armature, said armature being connected to a hollow pivot spindle and including at least one passage which extends through the armature transversely with respect to the direction of movement of the armature and is in communication with the interior of said hollow pivot spindle for conducting a pressure medium through said armature via said pivoting spindle.

2. An electromagnetic actuator according to claim 1, wherein the armature is pivotally supported and the medium is introduced into said armature at a first bearing point of said armature.

3. An electromagnetic actuator according to claim 2, wherein a play-compensating element is engaged by said armature and supplied with pressure medium via said at least one passage.

4. An electromagnetic actuator according to claim 2, wherein the pressure medium is removed at a second bearing point of said armature.

5. An electromagnetic actuator according to claim 1, wherein said passage extends in a curved manner through said armature.

6. An electromagnetic actuator according to claim 1, wherein a partition is disposed between the bearing points in said pivoting spindle.

7. An electromagnetic actuator according to claim 6, wherein the pivoting spindle is connected via the partition to a torsion spring extending into said spindle from one end thereof.

8. An electromagnetic actuator according to claim 2, wherein the armature is mounted at least at one end thereof by a bearing bolt extending into said spindle and said medium is fed into said armature through a passage in said bearing bolt.

* * * * *